US007296968B2

(12) United States Patent
Ho

(10) Patent No.: US 7,296,968 B2
(45) Date of Patent: Nov. 20, 2007

(54) FAN ACCELERATION STRUCTURE

(76) Inventor: Kuan-Hua Ho, 4F, No. 345, Chung Chen Rd., Hsin Chuang City, Taipei Shien (TW)

( * ) Notice: Subject to any disclaimer, the term of this patent is extended or adjusted under 35 U.S.C. 154(b) by 394 days.

(21) Appl. No.: 11/030,841

(22) Filed: Jan. 6, 2005

(65) Prior Publication Data

US 2006/0172686 A1 Aug. 3, 2006

(51) Int. Cl.
*F01D 15/12* (2006.01)
*F04D 29/00* (2006.01)

(52) U.S. Cl. ..... 415/124.2; 416/162; 416/170 R

(58) Field of Classification Search ..... 415/124.1, 415/124.2; 416/60, 160, 162, 170 R, 171; 417/423.1, 423.6
See application file for complete search history.

(56) References Cited

U.S. PATENT DOCUMENTS 5,947,854 A * 9/1999 Kopko ..... 475/2
6,644,939 B2 * 11/2003 Vukovich et al. ..... 417/374
6,716,003 B2 * 4/2004 Chen ..... 417/415

* cited by examiner

*Primary Examiner*—Edward K. Look
*Assistant Examiner*—Dwayne J White
(74) *Attorney, Agent, or Firm*—Pro-Techtor Int'l Services

(57) ABSTRACT

The present invention relates to a fan acceleration structure of a shredder having a common shaft for a motor, a fan, and a gear set to enable the motor driving and accelerating the fan through a chain rotation from a drive gear, a connection gear to a driven gear.

3 Claims, 2 Drawing Sheets

FAN ACCELERATION STRUCTURE

BACKGROUND OF THE INVENTION (a) Field of the Invention

The present invention relates to a fan acceleration structure of a shredder and more particularly for a fan having a gear set to accelerate rotation of a fan.

(b) Description of the Prior Art

A conventional way to disperse heat from a shredder is to add an independent fan, with a separate connection to a power supply, to blow air to a motor, which presents defects such as enlarging the volume of the shredder and also being incapable of increasing fan speed.

SUMMARY OF THE INVENTION

The present invention is to provide a fan acceleration structure of a shredder having a common shaft for a motor and the fan, wherein the fan shaft connecting to a gear set to accelerate the fan speed.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
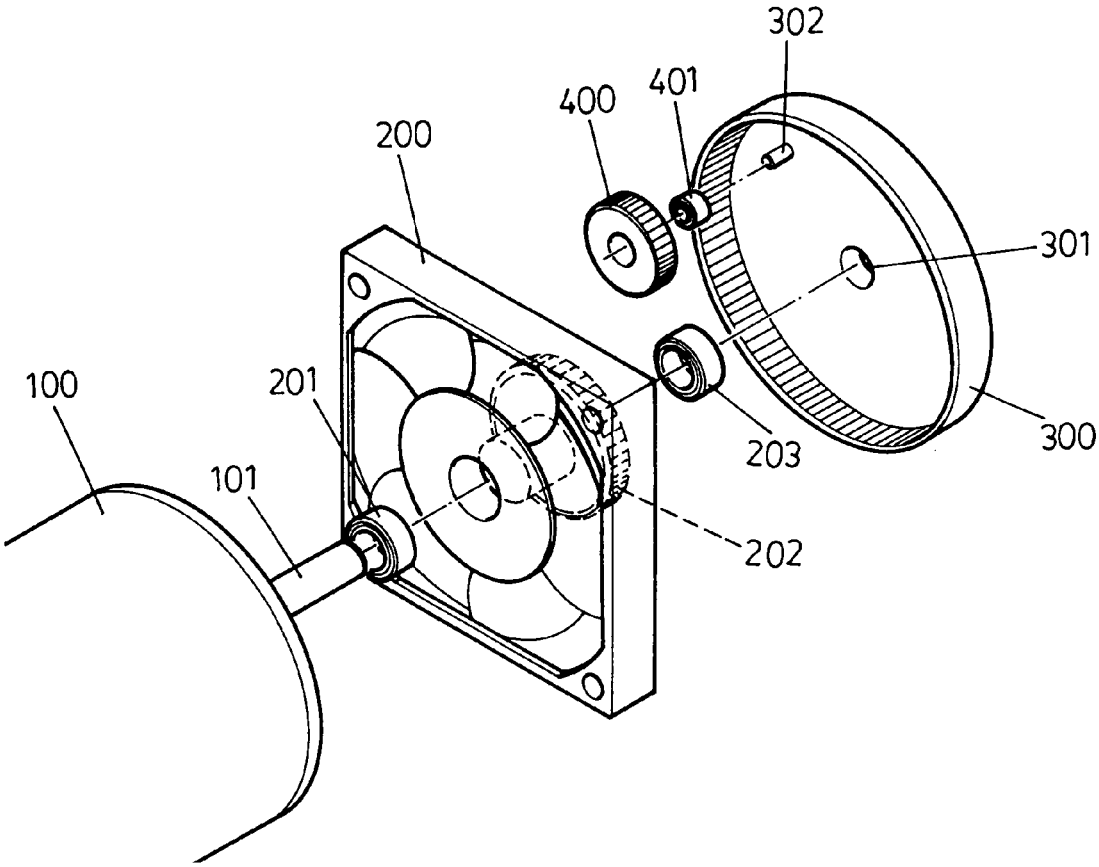
FIG. 1 shows an exploded elevational view of the present invention.
Figure 2:
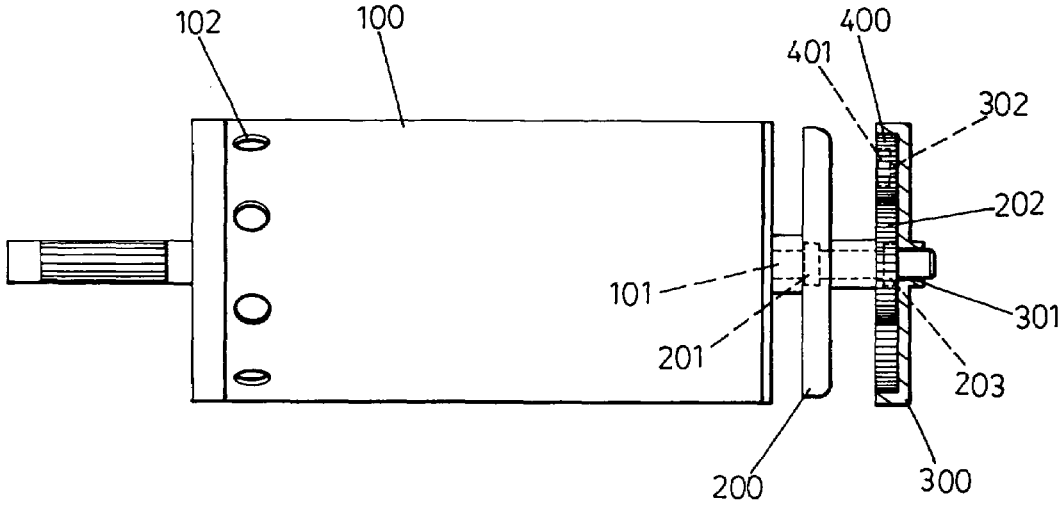
FIG. 2 shows a perspective view of the present invention.
Figure 3:
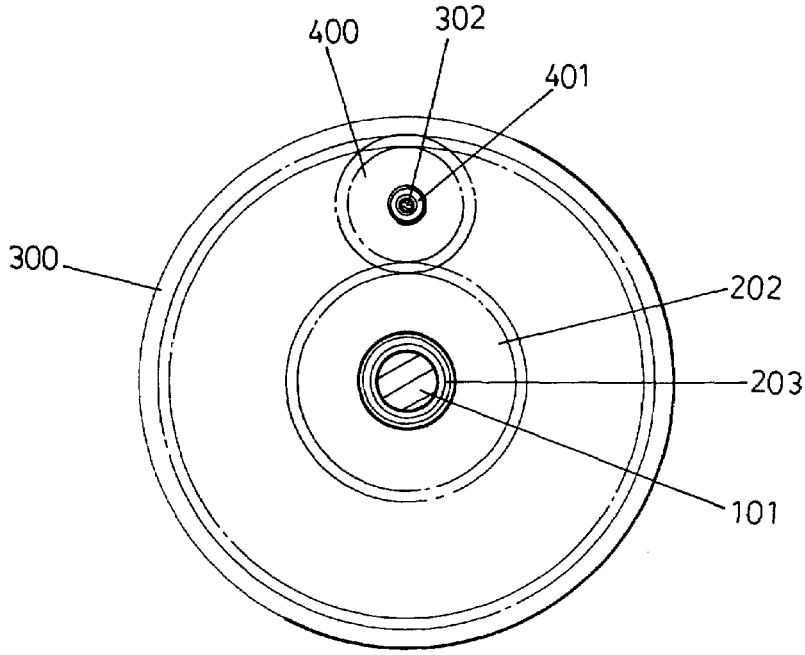
FIG. 3 shows a perspective view of a gear set of the present invention.

Referring to FIGS. 1-3. The present invention relates to a fan acceleration structure of a shredder having a motor 100, a fan 200, a ring drive gear 300, and a connection gear 400, wherein the motor 100 has a motor drive shaft 101, the fan 200 has a fan bearing 201 at the center, the ring drive gear 300 has a hub 301 having at a center thereof a sun-gear bearing 203 supporting a sun gear 202 and has a side shaft 302 on the redial direction surface, the connection gear 400, formed between the ring drive gear 300 and the sun gear 202, has a connection-gear bearing 401 with the side shaft 302 penetrating through the center thereof, and components of the motor drive shaft 101, the fan bearing 201, the sun gear 202, and the sun-gear bearing 203 may be connected in serial order. In one embodiment, the motor drive shaft also has a second shaft end which projects from the opposite end of the motor from the fan, and may be used to drive other apparatus. Turning on the motor 100 will drive the sun-gear bearing 203 to rotate the ring drive gear 300, which then to rotate the fan 200 through the sun gear 202 and the connection gear 400, thereby enabling the fan 200 having an accelerated speed=$N_1$×(ring drive gear 300/connection gear 400)×(connection gear 400/sun gear 202), when the motor 100 and the ring drive gear 300 having a speed $N_1$.

Referring to FIG. 2. The motor 100 can be with openings 102 at the other end to facilitate heat dispersal.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A fan acceleration structure of a shredder comprising
a motor with at least one projecting drive shaft;
a fan further comprising
a hub, mounted coaxially on said drive shaft with at least one rotational bearing,
a plurality of fan blades attached to said hub, and
a sun gear, having gear teeth on an outer diameter, attached coaxially to said hub;
a ring drive gear, having
gear teeth on an inner diameter thereof,
a ring gear hub fixedly attached to said drive shaft, and
at least one side shaft, fastened to said ring gear hub, parallel to and radially offset from said drive shaft; and
at least one connection gear, having gear teeth on an outer diameter, each mounted coaxially on one said side shaft with at least one rotational bearing;
wherein the ring drive gear is driven by the motor shaft, the connection gear teeth engage with and are urged to rotate by the ring drive gear teeth, the connection gear teeth in turn engage with the sun gear teeth urging the fan to rotate at an accelerated speed compared to the motor.

2. The fan acceleration structure of a shredder as recited in claim 1, wherein the motor comprises openings, at an end opposite from the fan, for dispersing heat.

3. The fan acceleration structure of a shredder as recited in claim 1, wherein the motor drive shaft having a second shaft end which projects from the motor at a motor end opposite to the drive shaft which engages the fan.

* * * * *